US006634151B1

(12) United States Patent
Roth

(10) Patent No.: US 6,634,151 B1
(45) Date of Patent: Oct. 21, 2003

(54) SUPPORT APPARATUS FOR SUPPORTING ONE OR MORE OBJECTS FROM A CONCRETE STRUCTURE

(76) Inventor: Steven A. Roth, P.O. Box 0933, Alamo, CA (US) 94507

( * ) Notice: Subject to any disclaimer, the term of this patent is extended or adjusted under 35 U.S.C. 154(b) by 127 days.

(21) Appl. No.: 09/769,608

(22) Filed: Jan. 25, 2001

(51) Int. Cl.[7] ..... E04B 1/38; E04C 5/00

(52) U.S. Cl. ..... 52/367; 52/699; 52/700; 52/677; 248/58; 248/343

(58) Field of Search ..... 52/319, 326, 351, 52/677, 698, 699, 700, 701, 704, 712, 125.4, 367, 336, 407, 679, 680, 681, 682; 248/343, 58

(56) References Cited

U.S. PATENT DOCUMENTS 1,114,013 A * 10/1914 Millar
3,372,523 A * 3/1968 Hall
3,728,835 A * 4/1973 McManus ..... 52/334
3,843,080 A * 10/1974 Imai et al.
4,118,910 A * 10/1978 McSherry et al.
5,205,690 A 4/1993 Roth
5,307,602 A * 5/1994 Lebraut
5,428,936 A 7/1995 Roth
5,937,609 A 8/1999 Roth

OTHER PUBLICATIONS

Tolco pipe hangers & supports Catalog dated Nov. 1, 1994, p. 69.
Fig. 109EZ on p. 68 (same catalog). ITW Ram Set/Red Head 1992 Catalog, p. A42.
B–Line Systems, Inc. Strut Systems engineering Catalog (BLZR edition), p. 155.

* cited by examiner

*Primary Examiner*—Robert Canfield
(74) *Attorney, Agent, or Firm*—Thomas R. Lampe

(57) ABSTRACT

Support apparatus for supporting one or more objects from a concrete structure includes an insert for embedment in the concrete structure and a hanger rod connected to, extending downwardly from and supported by the insert. The hanger rod includes an end that extends over a top member of the insert and the insert and hanger rod include structure cooperating to maintain the hanger rod at a desired location relative to the insert.

27 Claims, 11 Drawing Sheets

SUPPORT APPARATUS FOR SUPPORTING ONE OR MORE OBJECTS FROM A CONCRETE STRUCTURE

TECHNICAL FIELD

This invention relates to support apparatus for suspending one or more objects from a concrete structure. The invention is applicable to connect objects to concrete ceilings and even more particularly to concrete ceilings formed on metal decking.

BACKGROUND OF THE INVENTION

It is well known to employ concrete inserts to connect items to concrete structures after the concrete has been poured and hardened. Typically, an insert is embedded in a concrete ceiling so that pipe hangers or other objects can be connected to the ceiling by the insert after the concrete hardens.

My U.S. Pat. No. 5,937,609, issued Aug. 17, 1999, relates to a concrete insert with a C-shape and having a flat bottom plate and a top plate connected by a side plate, with the planes of the top and bottom plates being parallel. The top plate and bottom plate each define a hole with centers of these holes lying along the same axis. Means is associated with the top and bottom holes to threadedly engage and support a threaded hanger rod.

My U.S. Pat. No. 5,205,690, discloses another form of insert which is U-shaped and formed of bent sheet metal. In the device the bridge between the legs of the U-shaped insert contains a hole or an opening through which an internally threaded coupling extends.

My U.S. Pat. No. 5,428,936, issued Jul. 4, 1995, discloses a concrete insert including an insert element in the form of a plate defining an aperture. An elongated connector shaft is positioned in the plate and extends through the plate. The elongated connector shaft is threaded along at least a portion of the length thereof. An anchor element is affixed to the elongated shaft for embedment in concrete when the insert apparatus is attached to a concrete structure.

Tolco Incorporated of Corona, Calif. and others make available a widely employed concrete deck insert which consists of a flat plate and a J-bolt or other type of threaded hanger threadedly secured thereto. The plate bridges recessed channels formed in metal decking used to support the concrete with the J-bolt or other type of rod screwed up or down relative to the plate to position the top thereof at a desired location within the concrete after it is poured. Such an arrangement is shown in the Tolco pipe hangers and supports Catalog dated Nov. 1, 1994, page 69.

FIG. 109EZ on page 68 of the same catalog discloses another form of concrete deck insert which is in the nature of a plate bridging channels of the decking and having a U-shaped bend. Aligned holes are formed in the bend and the J-bolt hanger rod upper end is inserted in the holes to position the hanger rod in place prior to pouring of the concrete.

Another type of commonly used concrete insert hanger attached to metal decking of a concrete ceiling is represented by that shown in the ITW Ram Set/Red Head 1992 Catalog, page A42. This type of device is known as a combination type hanger/shear stud fastener.

The B-Line Systems Inc. strut systems engineering catalog (BLZR edition), page 155, shows other types of concrete inserts.

DISCLOSURE OF INVENTION

The support apparatus of the present invention, in common with prior art structures, employs an insert positioned on metal decking which supports a hanger rod.

The support apparatus of the present invention is characterized by its ease of use and versatility. There is no threading engagement between the insert and the hanger rod and the specific construction of the apparatus enables the insert to be utilized with a wide variety of hanger rod sizes and configurations. In addition, the support apparatus of the present invention affords additional strength due to the fact that a number of concrete bearing surfaces are provided on the apparatus (as compared with many prior art approaches) which, once embedded in concrete, provide enhanced bearing strength and support capability.

In addition, the hanger rods employed are automatically set at a predetermined embedment height without the necessity of threading the hanger rod or making other time consuming adjustments.

Furthermore, the support apparatus of the present invention can readily be utilized to hold and lock into place concrete reinforcement members such as reinforcement bars or wire mesh.

A number of embodiments of the support apparatus insert are disclosed herein and utilizing at least some of the embodiments the embedment depth of the hanger rod may be changed merely by changing the configuration of the hanger rod. In addition, the insert employed in the support apparatus can be made of lighter gauge metal than prior art threaded plates utilized to span channels in decking, particularly those prior art arrangements providing a threaded interconnection between the insert and the hanger rod.

The support apparatus of the present invention is for supporting one or more objects from a concrete structure.

The support apparatus includes an insert for embedment in the concrete structure, the insert including an insert base, a double-ended top member connected at one of the ends thereof to the insert base and disposed above the insert base, and a first insert leg attached to the other of the ends of the top member, and extending downwardly from the top member. The first insert leg has a leg distal end engaging the insert base.

The support apparatus also includes a hanger rod connected to, extending downwardly from, and supported by the insert.

The hanger rod includes a substantially straight, elongated first hanger rod segment and a second hanger rod segment. The second hanger rod segment is bent relative to the substantially straight elongated first hanger rod segment and extends laterally away from the substantially straight elongated first hanger rod segment. The second hanger rod segment has a hanger rod distal end.

The substantially straight elongated hanger rod segment extends upwardly past the insert base and alongside the first insert leg. The second hanger rod segment extends over the top member.

Other features, advantages, and objects of the present invention will become apparent with reference to the following description and accompanying drawings.

MODES FOR CARRYING OUT THE INVENTION

Figure 1:
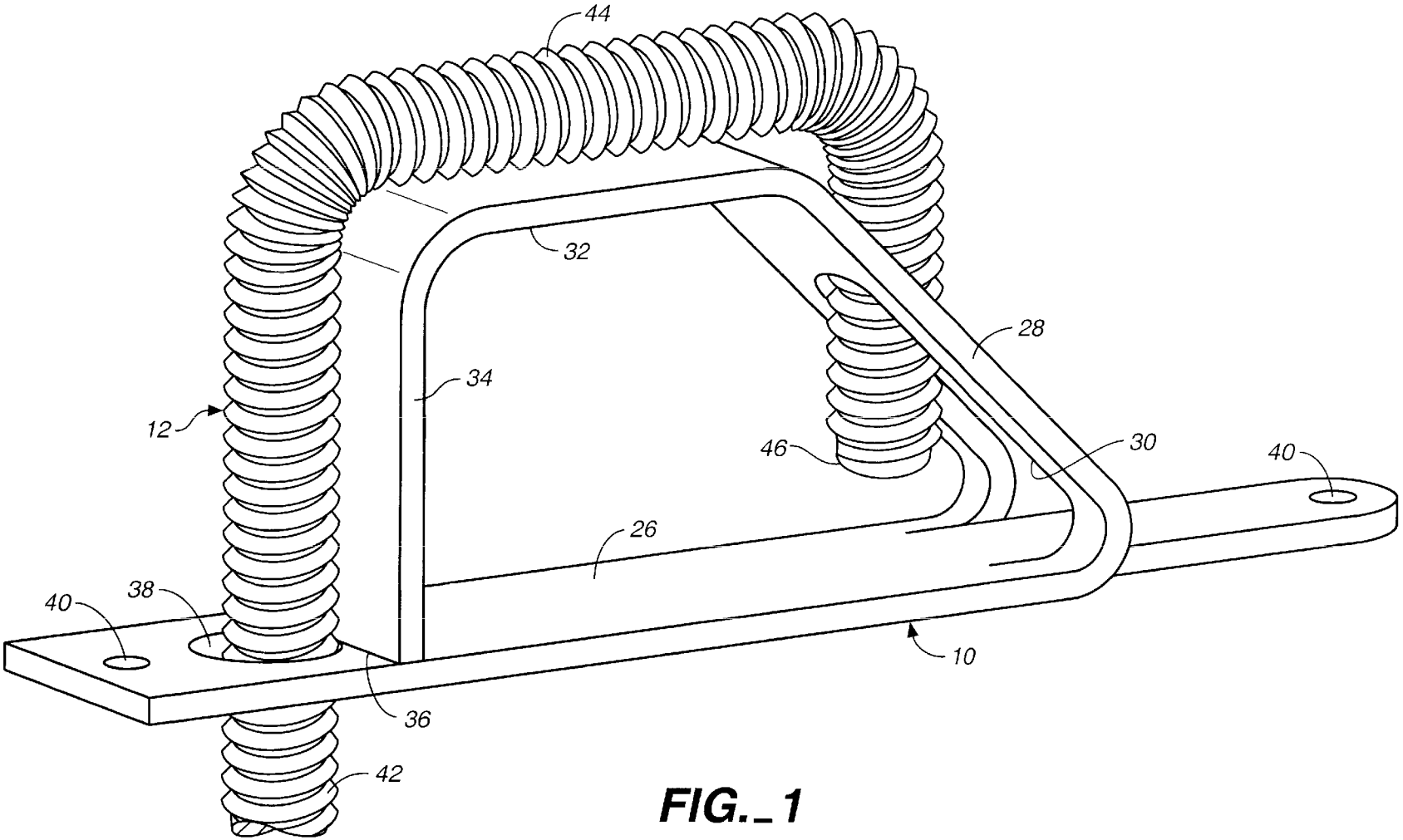
FIG. 1 is a perspective view of a preferred form of support apparatus constructed in accordance with the teachings of the present invention.
Figure 2:
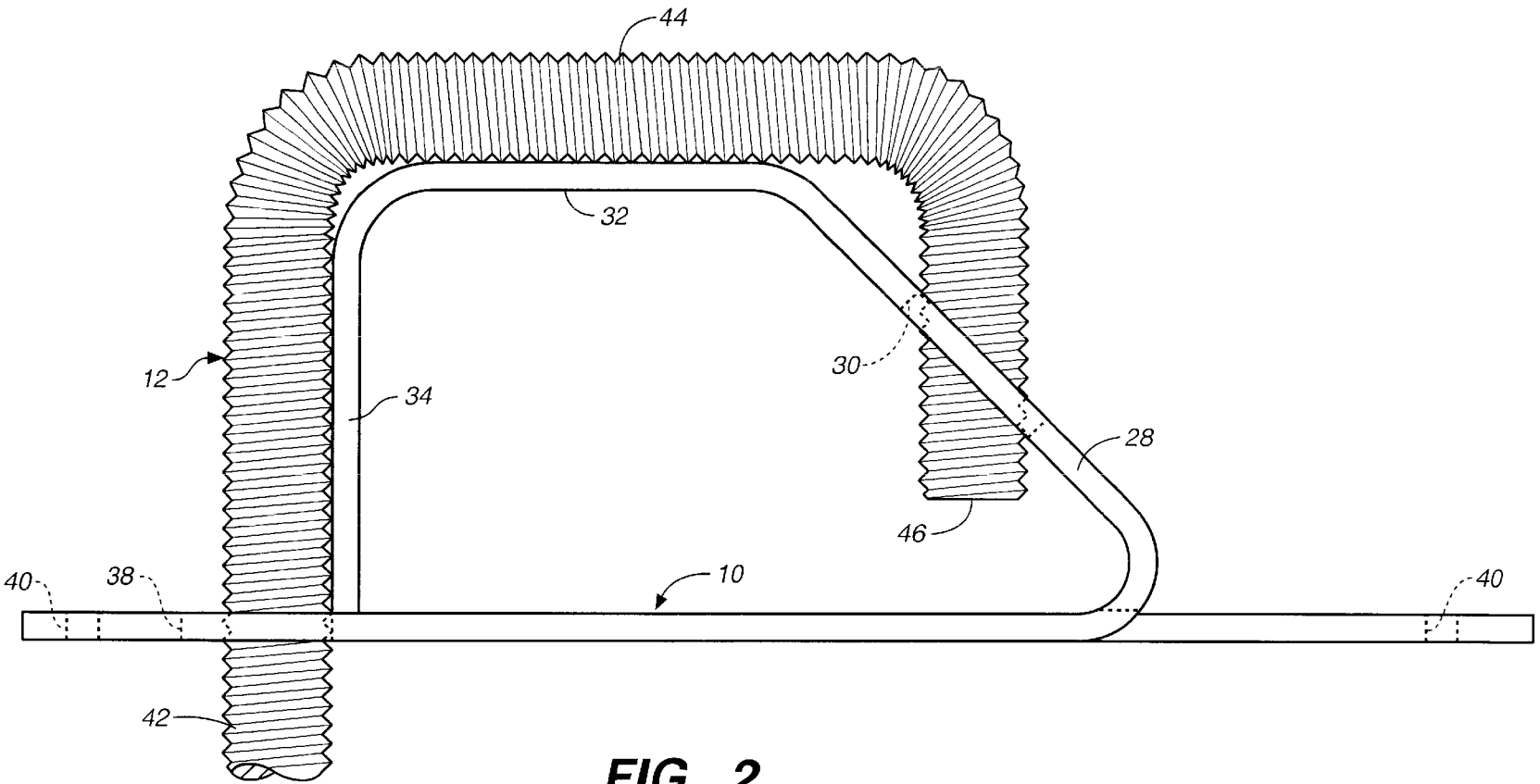
FIG. 2 is a side elevational view of the support apparatus of FIG. 1.
Figure 3:
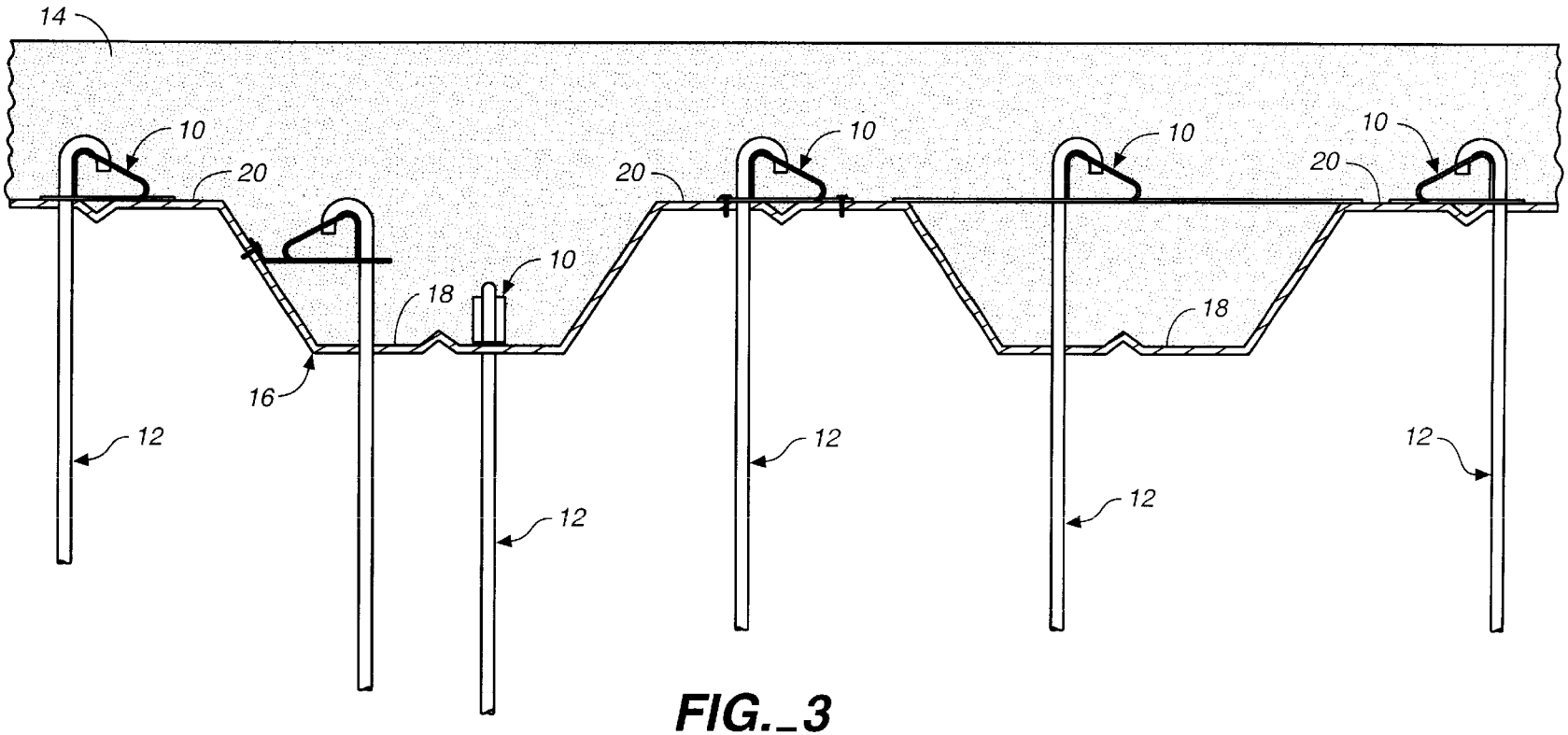
FIG. 3 is a cross-sectional, side view taken along a concrete structure supported by metal decking and illustrating support apparatus constructed in accordance with the teachings of the present invention in three different orientations relative to the concrete structure and decking.
Figure 4:
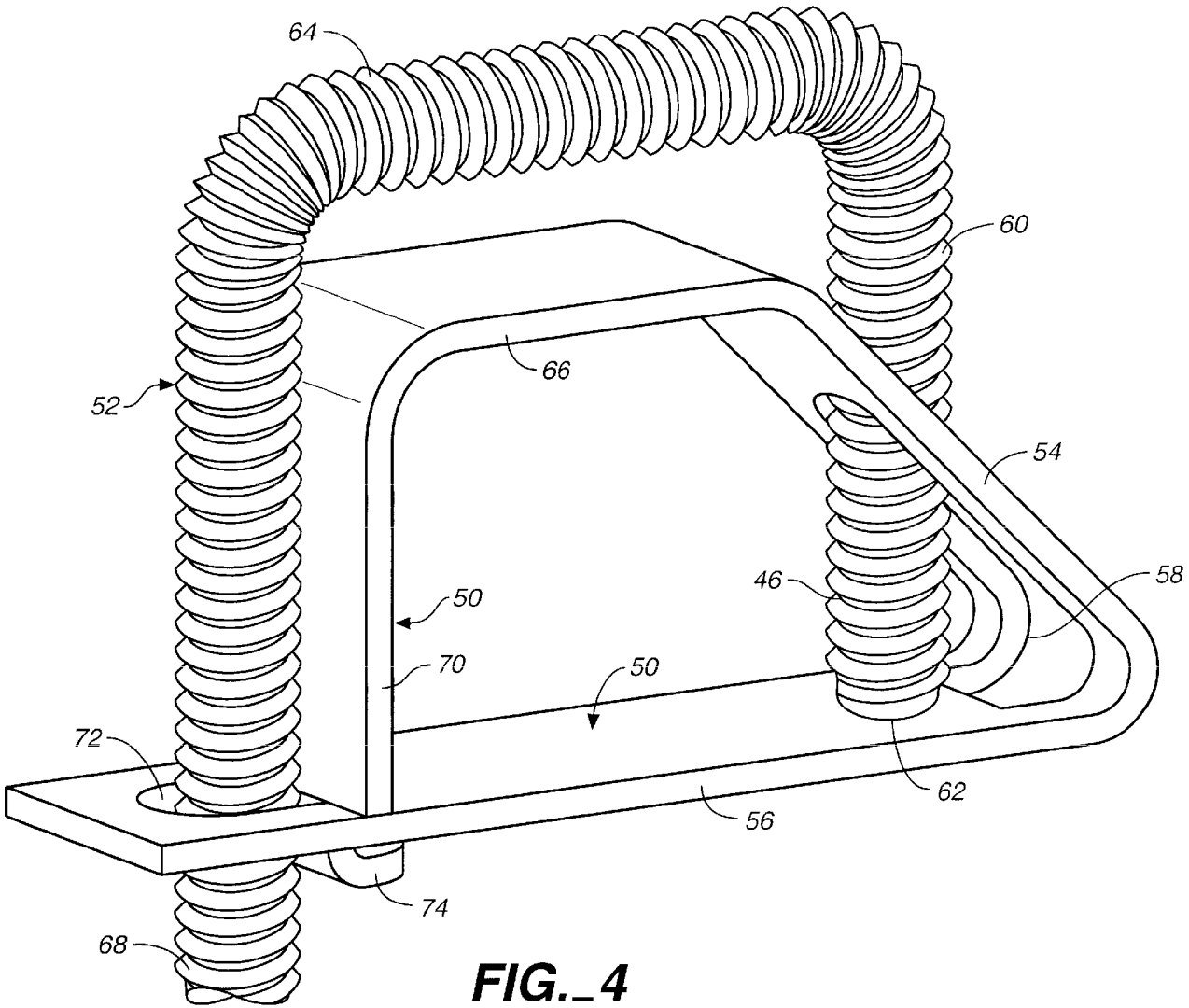
FIG. 4 is a perspective view of an alternative embodiment of the support apparatus.
Figure 5:
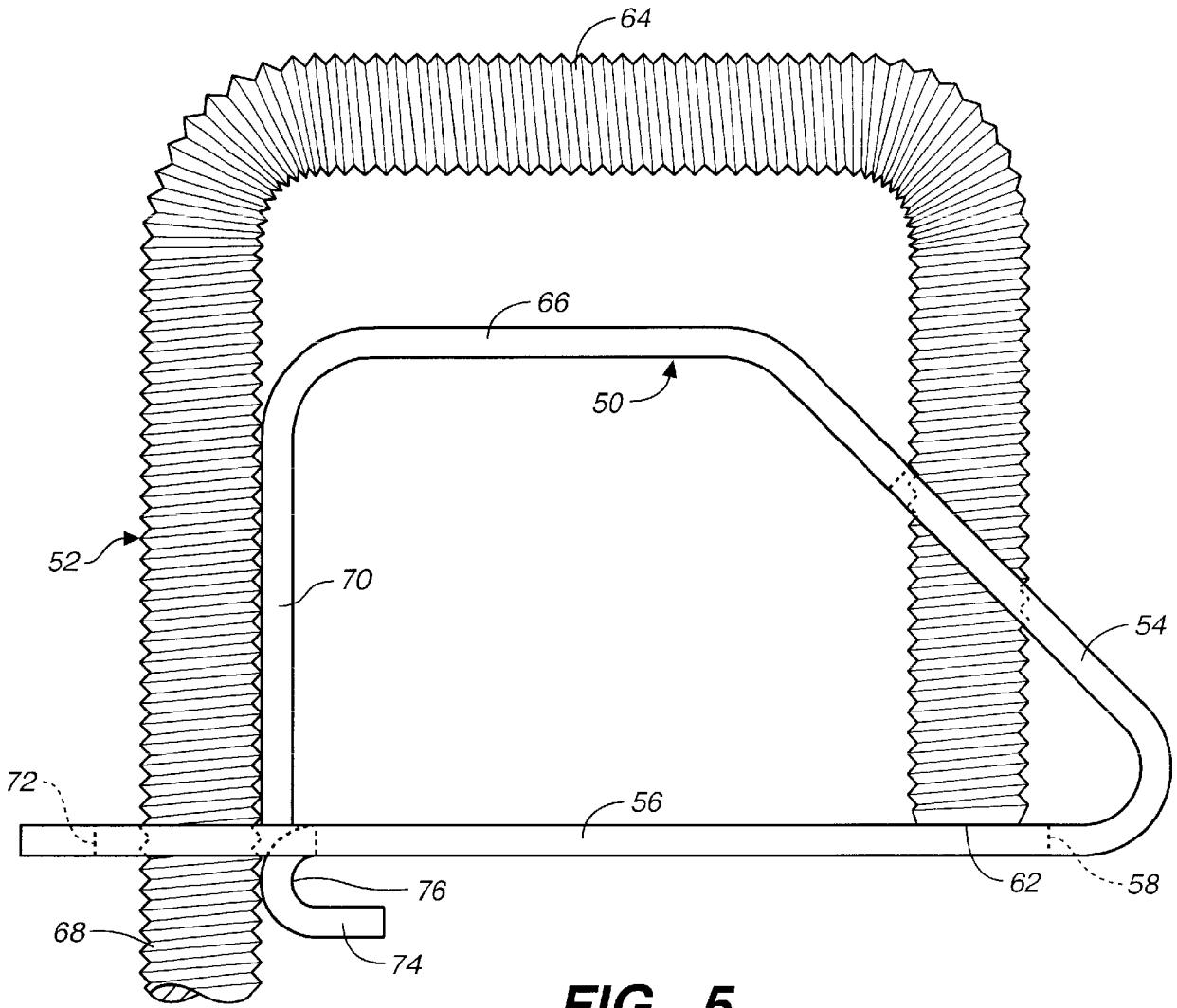
FIG. 5 is a side, elevational view of the support apparatus of FIG. 4.

Referring now to FIGS. 1–3, a preferred form of support apparatus for supporting one or more objects from a concrete structure is illustrated.

The support apparatus includes an insert 10 and a threaded hanger rod 12.

In FIG. 3 the support apparatus is shown installed at various locations in a concrete structure, more particularly a concrete ceiling 14 supported by metal decking 16. As is conventional, the metal decking 16 is comprised of a series of alternating channels defining spaced troughs 18 interconnected by ridge members 20. During formation of the concrete structure, the concrete is poured onto the metal decking. In the arrangement illustrated, holes have been punched or drilled in the metal decking at the locations where the hanger rods of the support apparatus of the present invention are positioned.

Each insert 10 is positioned on the decking and is then embedded in the poured concrete along with the upper end of the hanger rod supported thereby and depending therefrom.

Insert 10 includes an insert base 26. Integrally formed therewith and extending upwardly from the insert base is an insert leg 28 defining an elongated slot 30 therein.

A double-ended top member 32 is integrally connected at one of the ends thereof to insert leg 28. The top member 32 is generally parallel to the insert base and the insert leg 28 defines an acute angle with the insert base.

Integrally attached to top member 32, spaced from insert leg 28 and projecting downwardly from the top member is an insert leg 34 having a distal end 36. The distal end 36 engages the insert base and may, if desired, be welded or otherwise positively secured thereto.

The insert base 26 defines a hole 38 closely adjacent to insert leg 34. Other holes 40 are formed in the insert base for receiving screws or other mechanical fasteners which can be used to attach the insert to the metal decking. In the arrangement illustrated, the insert base 26 is of unitary construction, being formed preferably of metal plate material.

Hanger rod 12 is connected to, extends downwardly from and is supported by the insert 10. The hanger rod includes a straight, elongated first hanger rod segment 42 and a second hanger rod segment 44 having a hanger rod distal end 46. The hanger rod segment 44 is bent relative to the hanger rod segment 42 and extends laterally away from the hanger rod segment 42. The hanger rod segment 42 extends upwardly through hole 38 past the insert base 26 and alongside insert leg 34. The second hanger rod segment 44 extends over top member 32 and is engaged with and supported thereby. The second hanger rod segment 44 passes down through slot or opening 30 with the distal end 46 disposed below insert leg 28.

The hole 38 is larger than the cross-section of the hanger rod and the hanger rod is not threadedly attached to the insert at any location. The hole is large enough to accommodate different sized hanger rods.

After the support apparatus has been installed in place on the decking, concrete is poured and the insert and upper extent of the hanger rod are embedded in place in the concrete. The undersides of top member 32 and insert leg 28 bear against concrete disposed thereunder. Furthermore, concrete engages the hanger rod and it too incorporates concrete bearing surfaces.

FIG. 3 shows the support apparatus embedded in the concrete structure in three different orientations. The insert base 26 can be positioned on the flat decking portions of either the troughs 18 or the ridge members 20. Furthermore, the insert base can be installed so that it extends from ridge member to ridge member and spans a trough. Because concrete is in the spanned trough, the concrete, and not the insert base, will provide support strength for the insert and the hanger rod.

FIGS. 4–9 illustrate an alternative embodiment of the invention including an insert 50 and a threaded hanger rod 52. In this embodiment a slotted insert leg 54 proceeds directly up from one end of an insert base 56. Slot 58 in the insert leg 54 accommodates the end of second hanger rod segment 60. In this arrangement the distal end 62 of the hanger rod is in engagement with and supported by the top surface of insert base 56.

The second hanger rod segment 60 is sized so that the horizontal segment 64 thereof is disposed above and forms a space with top member 66 of the insert. The straight hanger rod segment 68 passes alongside insert leg 70 and through enlarged hole 72.

It will be noted that in this embodiment there are no holes similar to holes 40 of the first embodiment used to screw the insert into place on the metal decking. In this embodiment another approach is utilized to maintain the insert in place.

Figure 6A:
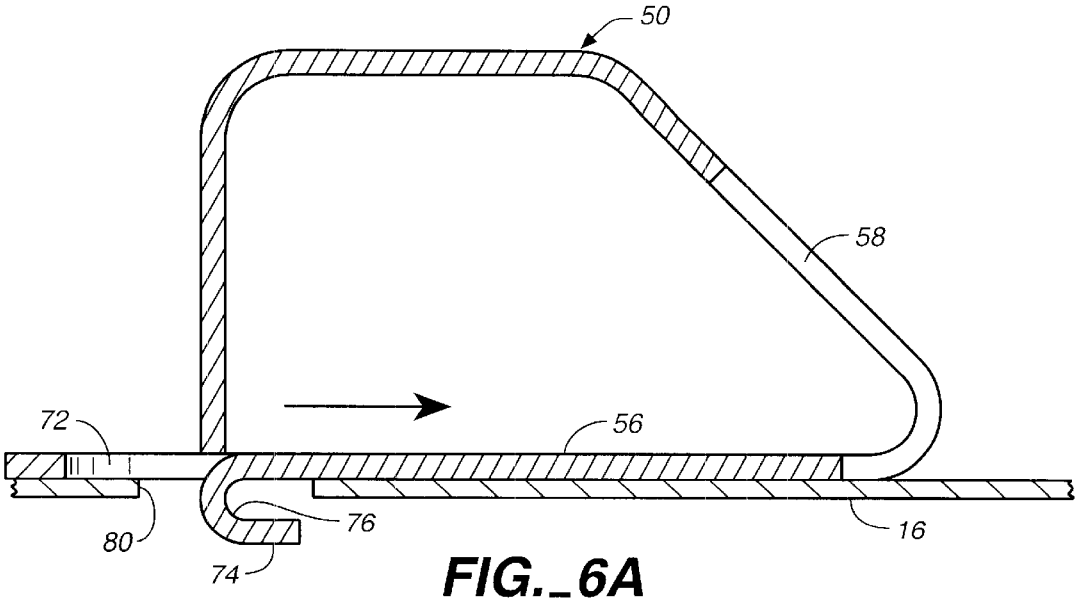
FIGS. 6A and 6B are cross-sectional, side, elevational views illustrating steps carried out in the installation of the support apparatus of FIG. 4 on metal decking.
Figure 6B:
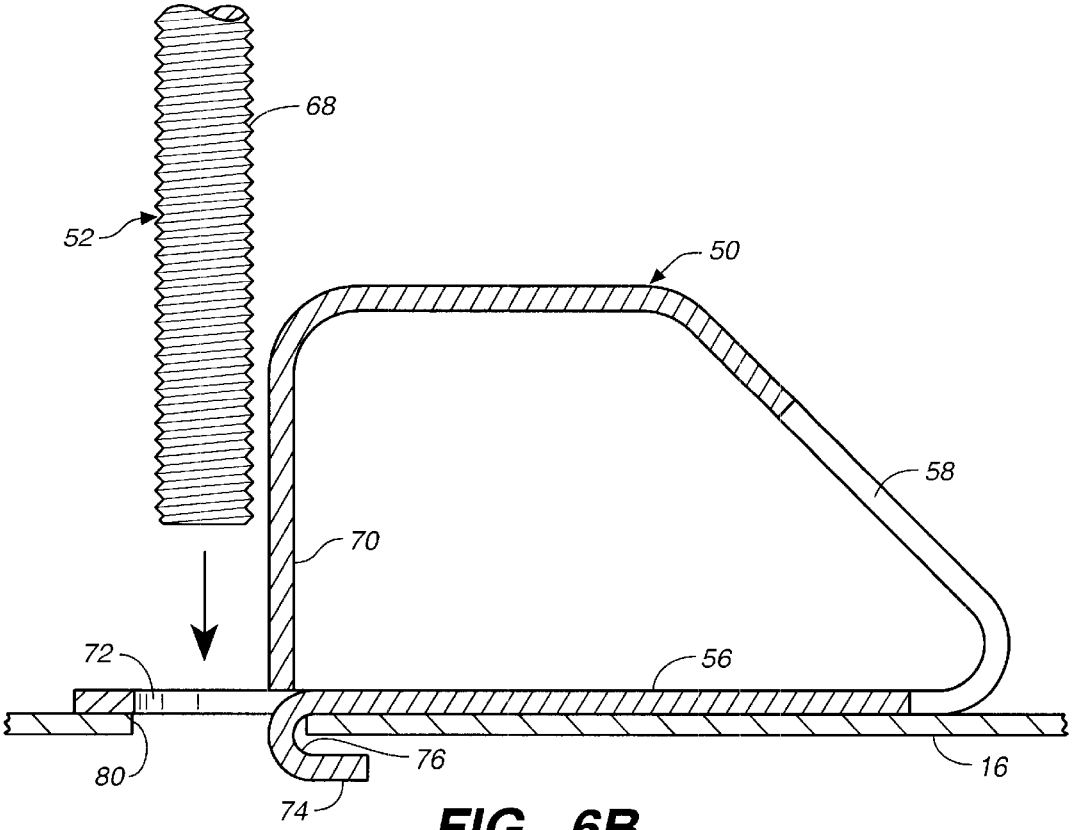
Figure 7A:
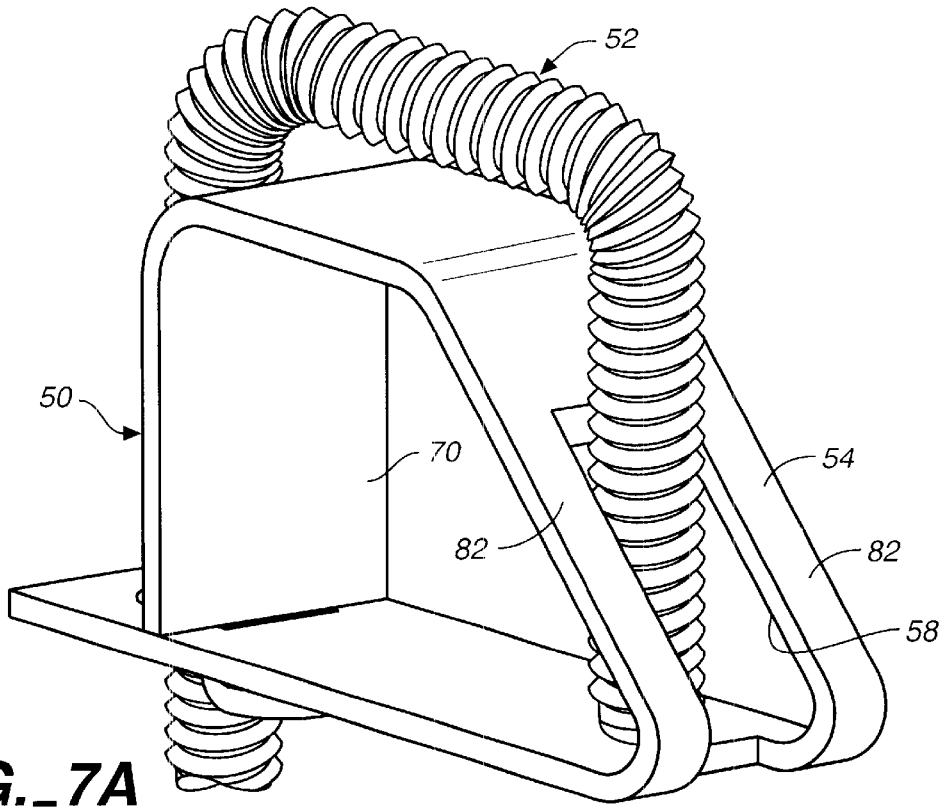
FIGS. 7A and 7B are perspective views illustrating the upper portion of a hanger rod connected to the insert of FIG. 4 and further illustrating the hanger rod in a slot formed in the insert, FIG. 7B specifically illustrating the technique of locking the hanger rod in place by applying clamping forces thereto at the slot location.
Figure 7B:
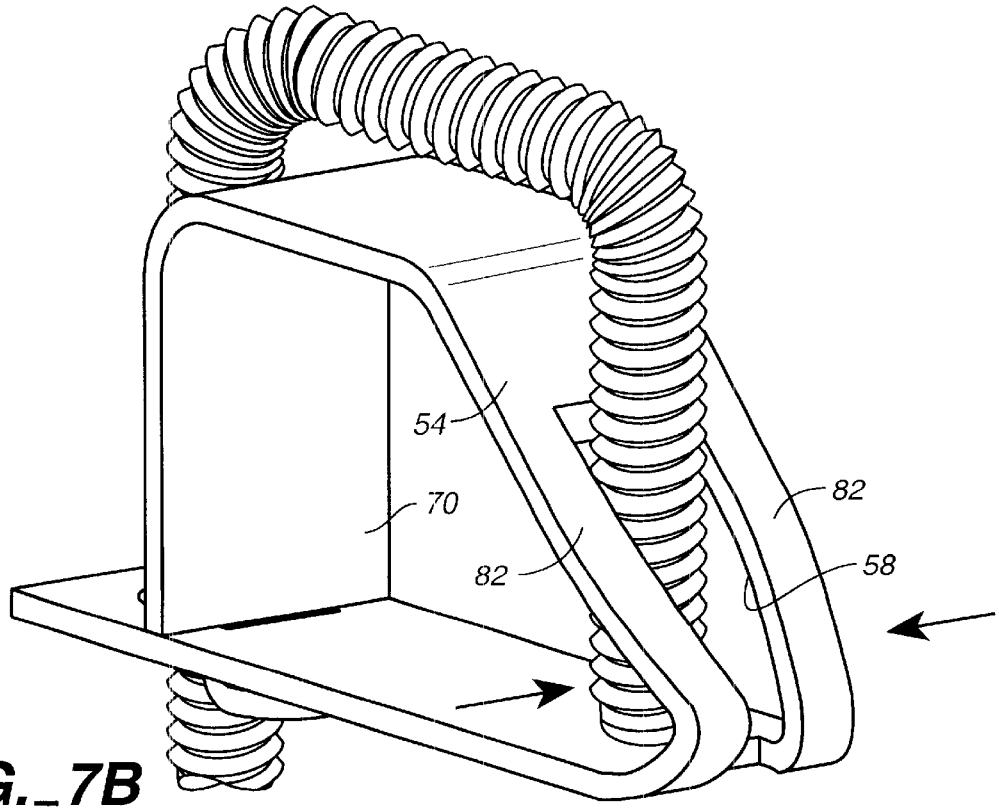

More specifically, a retention member or tab 74 is integrally formed with the insert base and extends downwardly therefrom. The retention member 74 and the bottom surface of the insert base define a space 76 for receiving the metal decking 16. Installation of the insert 50 on metal decking 16 is illustrated in FIGS. 6A and 6B.

First, the retention member 74 is located in a hole 80 formed in the metal decking formed by punching, drilling or the like. With the insert base 56 engaging the top of the metal decking, the insert is moved in the direction of the arrow shown in FIG. 6A.

Such movement causes an edge portion of the decking surrounding the hole to enter into space 76 and the projecting retention member 74 to be disposed under the decking.

Next, the elongated, straight first hanger rod segment 68 is passed through hole 72 in the insert base and thence through the hole 80 formed in the metal decking. This will lock the insert in place on the decking so that the insert and hanger rod are positively positioned in place during pouring of the concrete.

The slot 58 is defined by two segments 82 of the insert leg 54. If it is desired to lock the hanger rod in place on the insert, opposed forces (as represented by the arrows in FIG. 7B) are applied to the segments 82 to grippingly engage the end of the hanger rod disposed in slot 58. If desired, the same technique can be used to lock hanger rod 12 of the first embodiment described above in place in insert leg 28 of that embodiment. An interconnection of this type may be useful, for example, to keep the hanger rod and the insert together as a unit during shipping.

Figure 8:
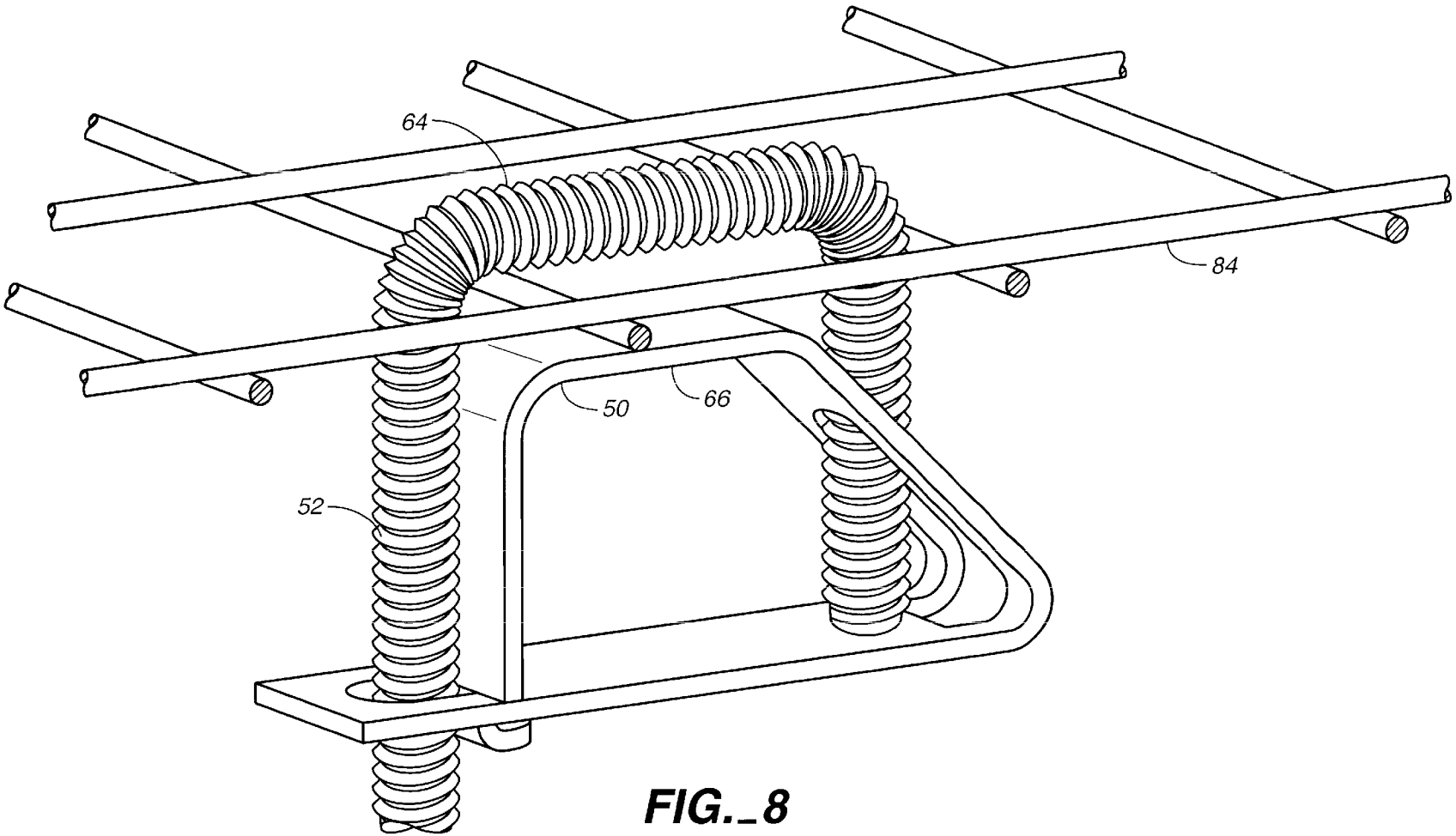
FIG. 8 illustrates the insert and hanger rod shown in FIG. 4 employed to position and lock into place wire mesh employed to reinforce concrete.

FIG. 8 shows how hanger rod 52 and insert 50 can be employed to support and lock into place concrete reinforcement material in the form of wire mesh 84. In this instance, the insert is first installed in place. The wire mesh 84 is then positioned on top member 66 to properly place and position the mesh prior to concrete pouring. Then the hanger rod 52 is installed with horizontal segment 64 thereof disposed over the mesh to keep it in position along with the insert 50 which the hanger rod has locked to the decking as described above.

Figure 9:
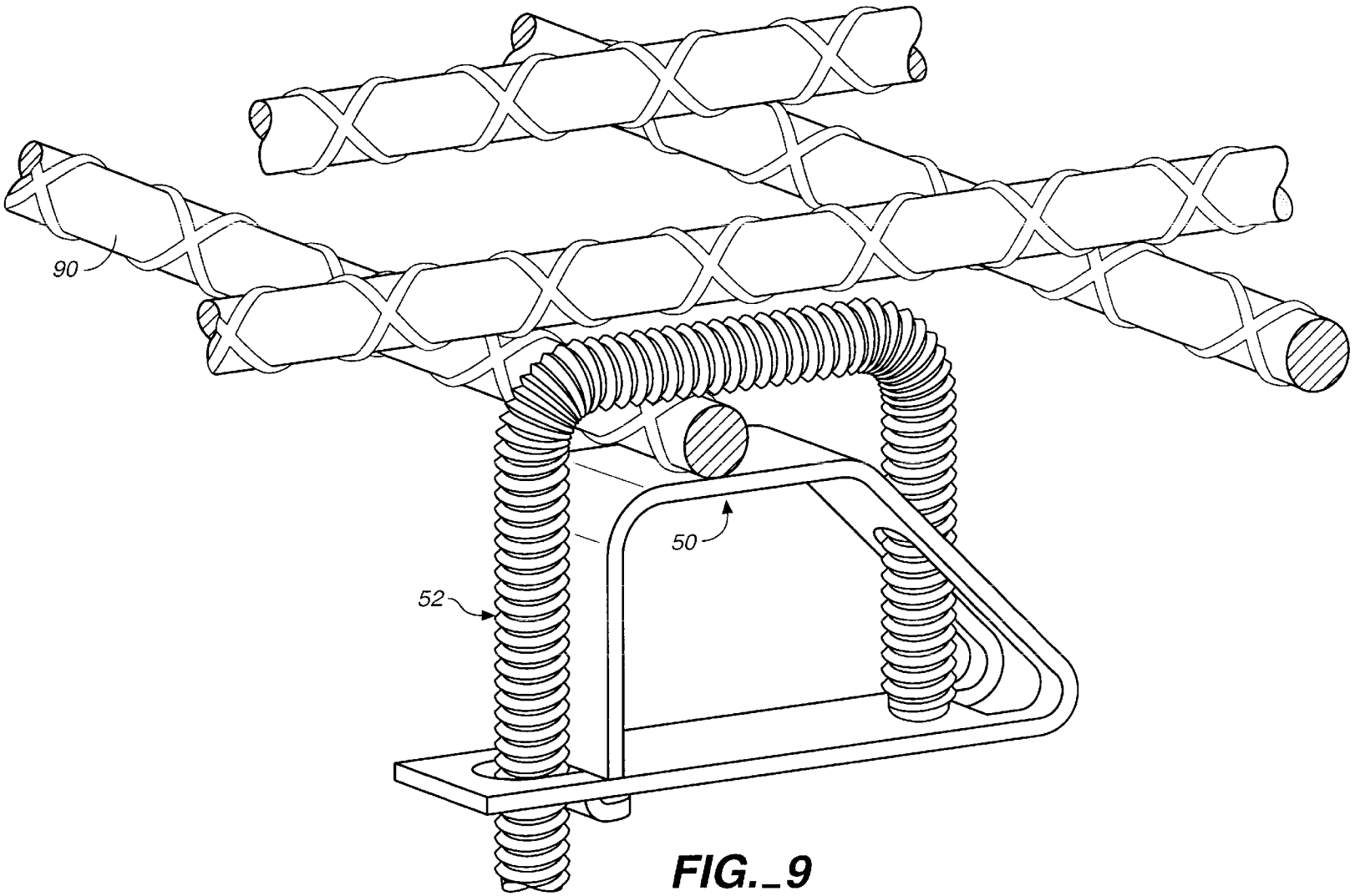
FIG. 9 is a view similar to FIG. 8, but illustrating the support apparatus employed to support and lock into place reinforcement bar for concrete.

FIG. 9 shows a similar approach wherein the concrete reinforcement material is in the form of reinforcement bar material 90.

Figure 10:
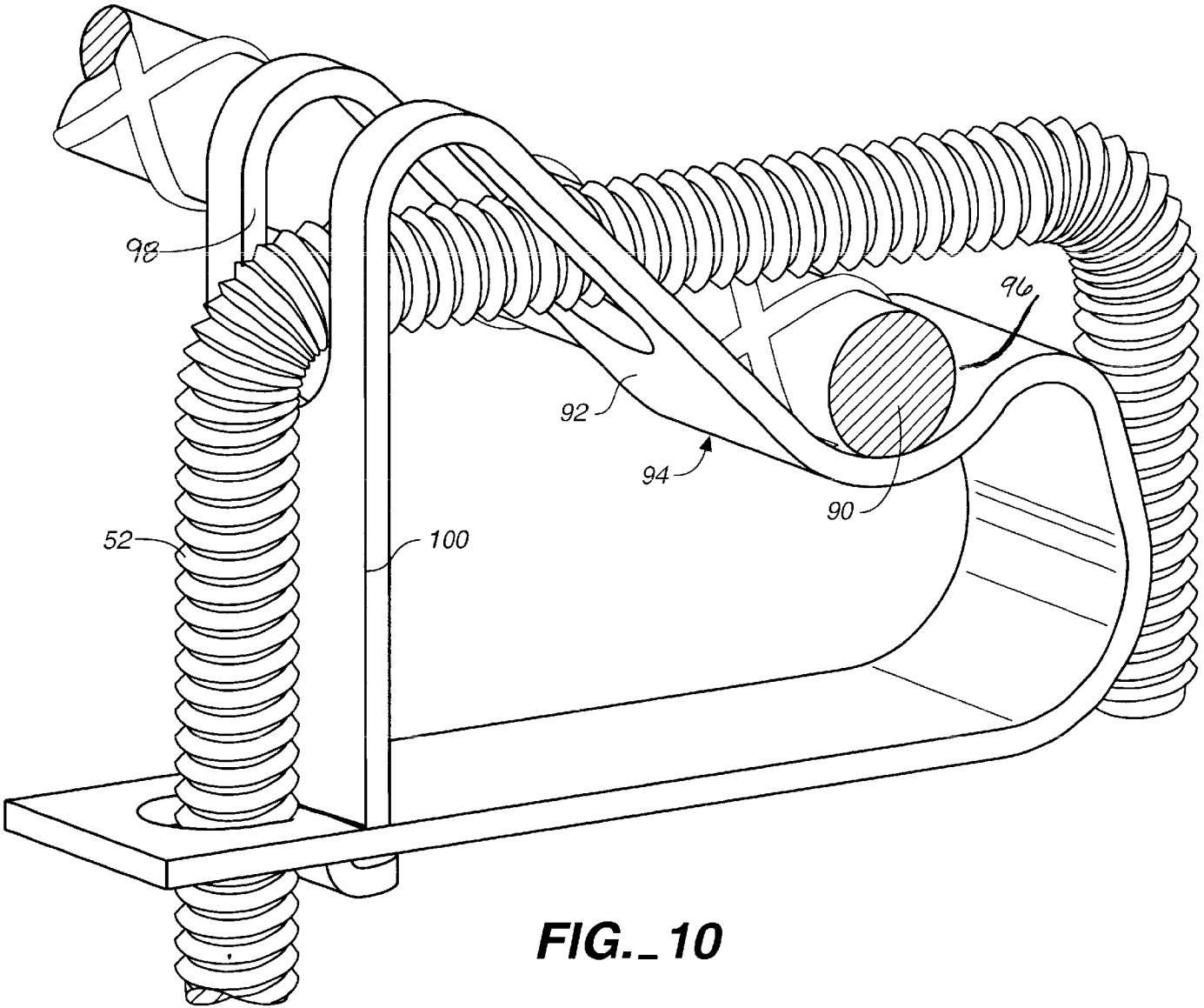
FIG. 10 illustrates another embodiment of the invention in association with concrete reinforcement bar material.

FIG. 10 illustrates another form of the invention wherein the top member 92 of insert 94 defines a concavity 96 for supporting reinforcement bar 90. In this embodiment a slot 98 is defined by the top member 92 and insert leg 100 for accommodating and positioning hanger rod 52, the latter being used to lock the reinforcement bar in place.

Figure 11:
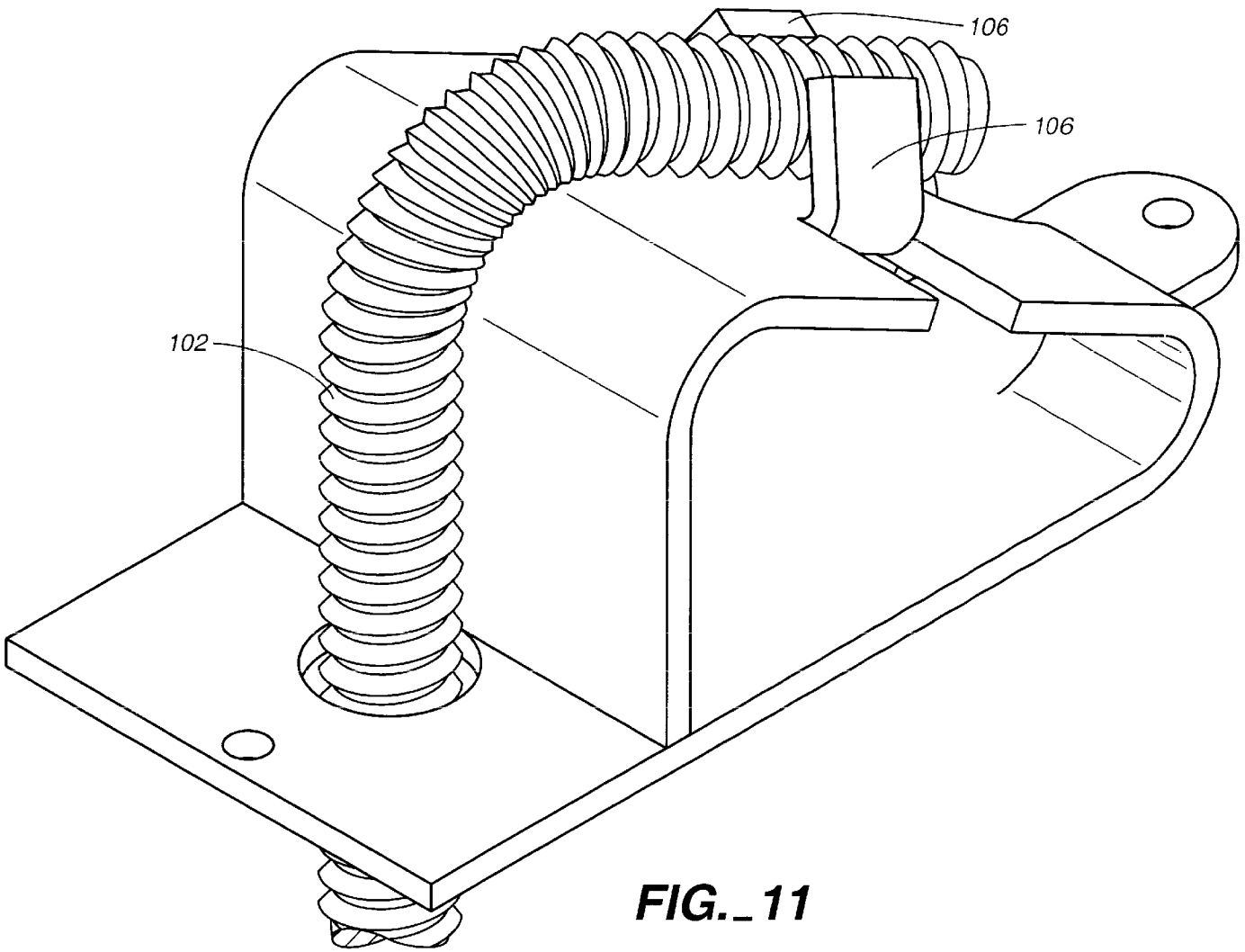
FIG. 11 shows yet another embodiment of the invention.

FIG. 11 illustrates yet another embodiment of the support apparatus wherein a hanger rod 102 is supported by an insert having lock members or tabs 106 connected thereto. After the hanger rod is positioned in place relative to the insert the lock members or tabs 106 are bent as shown to lock the hanger rod 102 in place.

The invention claimed is:

1. Support apparatus for supporting one or more objects from a concrete structure, said support apparatus comprising, in combination:

an insert for embedment in the concrete structure, said insert including an insert base, a double-ended top member connected at one of the ends thereof to said insert base and disposed above said insert base and a first insert leg attached to the other of the ends of said top member and extending downwardly from said top member, said first insert leg having a leg distal end engaging said insert base; and a hanger rod connected to, extending downwardly from, and supported by said insert, said hanger rod including a substantially straight, elongated first hanger rod segment and a second hanger rod segment bent relative to said substantially straight, elongated first hanger rod segment and extending laterally away from said substantially straight, elongated first hanger rod segment, said second hanger rod segment having a hanger rod distal end, said substantially straight, elongated first hanger rod segment extending upwardly past said insert base and alongside said first insert leg, and said second hanger rod segment extending over said top member.

2. The support apparatus according to claim 1 wherein said insert additionally includes a second insert leg spaced from said first insert leg extending upwardly from said insert base and connecting said top member to said insert base.

3. The support apparatus according to claim 1 wherein said insert base defines a hole adjacent to the first insert leg, said substantially straight, elongated first hanger rod segment being disposed in said hole.

4. The support apparatus according to claim 3 wherein said hole is larger than the cross-section of said substantially straight, elongated first hanger rod segment.

5. The support apparatus according to claim 1 wherein said second hanger rod segment is positioned on said top member in engagement with said top member.

6. The support apparatus according to claim 1 wherein the hanger rod distal end of said second hanger rod segment is in engagement with said insert base for providing support for said hanger rod.

7. The support apparatus according to claim 2 wherein said second insert leg forms an opening through which said second hanger rod segment passes.

8. The support apparatus according to claim 1 wherein said insert is of integral construction and formed of metal plate material.

9. The support apparatus according to claim 1 additionally comprising securement means for securing said insert base to metal decking associated with the concrete structure.

10. The support apparatus according to claim 9 wherein said securement means comprises a retention member extending downwardly from said insert base and defining a space with said insert base for receiving the metal decking.

11. The support apparatus according to claim 7 wherein said second insert leg defines an acute angle relative to said insert base.

12. The support apparatus according to claim 2 wherein said insert defines an opening located above said insert base accommodating said second hanger rod segment.

13. The support apparatus according to claim 12 wherein said opening comprises a slot accommodating said second hanger rod segment, said insert at said slot grippingly engaging said second hanger rod segment.

14. The support apparatus according to claim 13 wherein said slot is at least partially defined by said second insert leg.

15. The support apparatus according to claim 13 wherein said slot is at least partially defined by said top member.

16. The support apparatus according to claim 13 wherein said slot is at least partially defined by said first insert leg.

17. The support apparatus according to claim 13 wherein said slot is defined by and extends between and through said top member and said first insert leg.

18. The support apparatus according to claim 1 wherein said top member is substantially parallel to said insert base.

19. The support apparatus according to claim 2 wherein said top member defines an angle with said insert base and wherein said second insert leg forms an upwardly directed bend extending between said insert base and said top member.

20. The support apparatus according to claim 1 additionally comprising lock members connected to said insert and locking said second hanger rod segment in engagement with said insert.

21. The support apparatus according to claim 1 wherein said top member defines a concavity receiving a concrete reinforcement bar.

22. The support apparatus according to claim 21 wherein said second hanger rod segment extends over the concrete reinforcement bar.

23. The support apparatus according to claim 1 wherein said top member includes a concrete reinforcement mesh support surface engaged by concrete reinforcement mesh, said second hanger rod segment extending over the concrete reinforcement mesh.

24. The support apparatus according to claim 10 wherein said hanger rod is positioned adjacent to said retention member and cooperable with said retention member to restrict movement of said insert on the metal decking.

25. Support apparatus for supporting one or more objects from a concrete structure disposed on metal decking having channels, said support apparatus comprising in combination:

an insert for attachment to the metal decking for embedment in the concrete structure, said insert including an elongated, flat insert base having a length exceeding the length of a channel in the metal decking enabling the insert to span the channel, a double-ended top member connected at one end thereof to said elongated, flat insert base and disposed above said elongated, flat insert base and an insert leg attached to the other of the ends of said top member and extending downwardly from said top member, said insert leg having a leg distal end engaging said elongated, flat insert base; and a hanger rod connected to, extending downwardly from, and supported by said insert, said hanger rod including a substantially straight, elongated first hanger rod segment and a second hanger rod segment bent relative to said substantially straight, elongated hanger rod segment and extending laterally away from said substantially straight, elongated hanger rod segment, said second hanger rod segment extending over, engaging, and supported by said top member.

26. In combination:

a concrete structure; and support apparatus imbedded in the concrete structure for supporting one or more objects from the concrete structure, said support apparatus including an insert imbedded in the concrete structure, said insert including an insert base, a double-ended top member connected at one of the ends thereof to said insert base and disposed above said insert base and an insert leg attached to the other of the ends of said top member and extending downwardly from said top member, said insert leg having a leg distal end engaging said insert base, and a hanger rod connected to, extending downwardly from and supported by said insert and partially imbedded in the concrete structure, said hanger rod including a substantially straight, elongated first hanger rod segment and a second hanger rod segment bent relative to said substantially straight, elongated first hanger rod segment and extending laterally away from said substantially straight, elongated first hanger rod segment, said second hanger rod segment having a hanger rod distal end, said substantially straight, elongated hanger rod segment extending upwardly past said insert base and alongside said insert leg, and said second hanger rod segment extending over said top member.

27. In combination:

a concrete reinforcement member;

support apparatus supporting said concrete reinforcement member and for supporting one or more objects from a concrete structure, said support apparatus including an insert for embedment in the concrete structure, said insert including an insert base, a double-ended top member connected at one of the ends thereof to said insert base and disposed above said insert base and an insert leg attached to the other of the ends of said top member and extending downwardly from said top member, said insert leg having a leg distal end engaging said insert base, and a hanger rod connected to, extending downwardly from, and supported by said insert, said hanger rod including a substantially straight, elongated first hanger rod segment and a second hanger rod segment bent relative to said substantially straight, elongated first hanger rod segment and extending laterally away from said substantially straight, elongated first hanger rod segment, said second hanger rod segment having a hanger rod distal end, said substantially straight, elongated hanger rod segment extending upwardly past said insert base and alongside said insert leg, and said second hanger rod segment extending over said top member, said hanger rod connecting said concrete reinforcement member to said insert.

* * * * *